United States Patent [19]

Knudsen

[11] 4,214,403

[45] Jul. 29, 1980

[54] HINGE ELEMENT

[75] Inventor: Jens N. Knudsen, Billund, Denmark

[73] Assignee: Interlego, A.G., Switzerland

[21] Appl. No.: 947,433

[22] Filed: Oct. 2, 1978

[30] Foreign Application Priority Data

Oct. 13, 1977 [DK] Denmark ..... 4564/77

[51] Int. Cl.[2] ..... A63H 33/08; A63H 33/04

[52] U.S. Cl. ..... 46/25; 46/23

[58] Field of Search ..... 46/25, 26, 19, 23; 49/397, 398, 399, 401; 52/589, 590, 593; 16/171, 176, 168, 169

[56] References Cited

U.S. PATENT DOCUMENTS

| | | | |
|---|---|---|---|
| 2,245,875 | 6/1941 | Rutherford | 46/16 |
| 3,102,367 | 9/1963 | Pedersen | 52/437 |
| 3,231,929 | 2/1966 | Hiltmen et al. | 16/171 |
| 3,284,946 | 11/1966 | Christiansen | 46/19 |
| 3,496,670 | 2/1970 | Sloop et al. | 46/26 |
| 3,550,310 | 12/1970 | Bock-Greissau | 46/25 |
| 4,161,081 | 7/1979 | Katzman et al. | 46/12 |

FOREIGN PATENT DOCUMENTS

| | | | |
|---|---|---|---|
| 1254846 | 11/1971 | United Kingdom | 33/10 |

*Primary Examiner*—Louis G. Mancene
*Assistant Examiner*—Michael J. Foycik, Jr.
*Attorney, Agent, or Firm*—Stevens, Davis, Miller & Mosher

[57] ABSTRACT

A hinge element for toy building sets which is a pair of box-shaped toy building blocks hingedly interconnected by means of a tubular bush in one corner of one of the blocks and a complementary pivot pin in one corner of the other block, the arrangement of the bush and the pivot relatively to the blocks being such that, in the position wherein the pivot is rotatably mounted in the bush, the axis x of the bush and the axis y of the pivot both coincide with a corner edge in each block.

The two blocks: bush block 10*a* and pivot block 10*b* are provided with primary projections 14 extending outwardly from their bottom faces 13 and secondary projections 15 arranged in the cavity 16 of the blocks providing for detachable engagement with corresponding projections (coupling studs) of adjacent toy building blocks pertaining to the toy building set.

3 Claims, 8 Drawing Figures

HINGE ELEMENT

This invention generally relates to toy building sets and, more particularly, to a hinge element for hingedly interconnecting a pair of blocks pertaining to such building sets.

In prior art, as disclosed in British Patent No. 1,163,214, there is described a hinge element comprising a pair of toy building blocks moulded in an elastomeric synthetic resinous material, in which the blocks are hingedly and integrally united along one rectilinear edge of each block by means of a thin strip of the elastomeric material. In this hinge element the two blocks are thus permanently interconnected.

In the building sets to which the present invention primarily relates (an embodiment of which is described in U.S. Pat No. 3,005,282) the blocks are generally moulded in another plastic material which is not suitable for providing the thin strip described in British Patent No. 1,163,214.

Moreover, in the building sets of the kind referred to, the toy building elements should be adapted to be detachably interconnected and this also applies to the components of the hinge elements.

It is, therefore, an object of the invention to provide a hinge element comprising a pair of standard box-shaped toy building blocks substantially as described in the above mentioned USA Patent which are provided with hinge means adapted to enable the two blocks to be separated one from the other and to be interconnected for rotational movement along one rectilinear edge (corner edge) of each block defined by a pair of adjacent side walls thereof.

Figure 1:
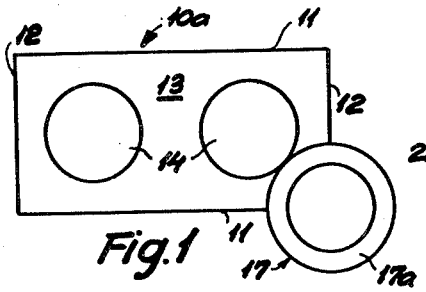
Figure 4:
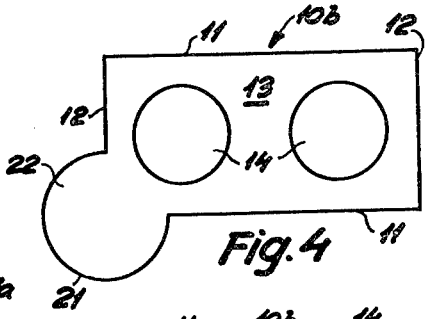
Figure 2:
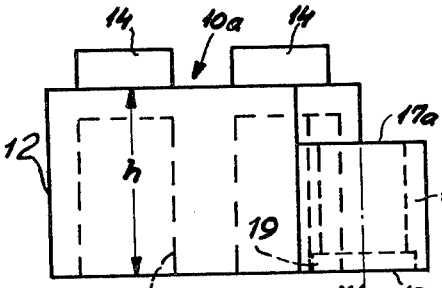
Figure 5:
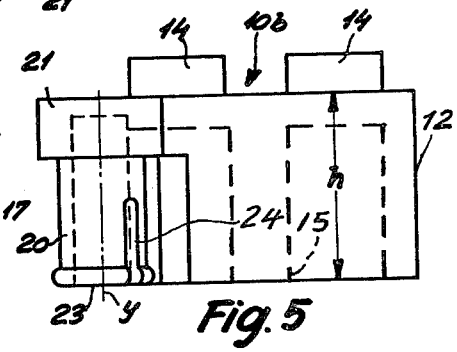
Figure 3:
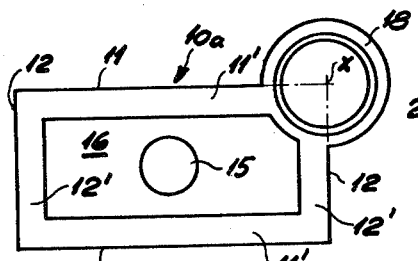
Figure 6:
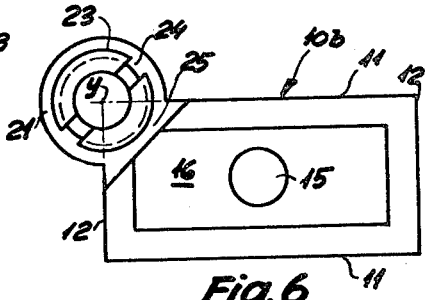
Figure 7:
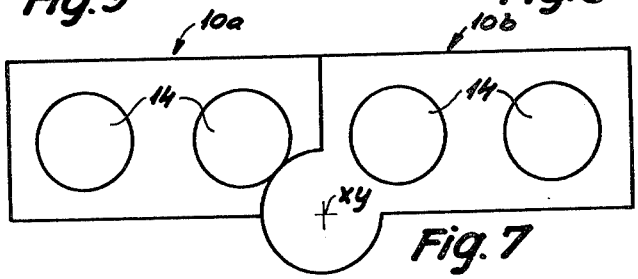
Figure 8:
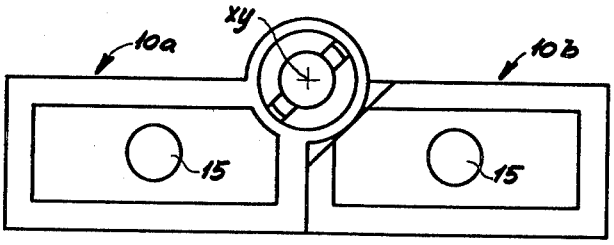
Figure 9:
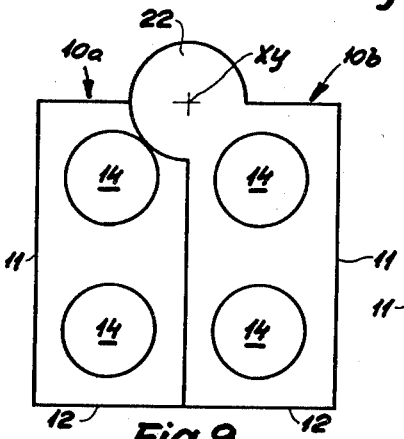
Figure 10:
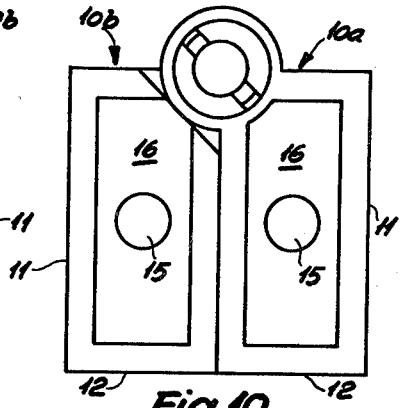
Figure 11:
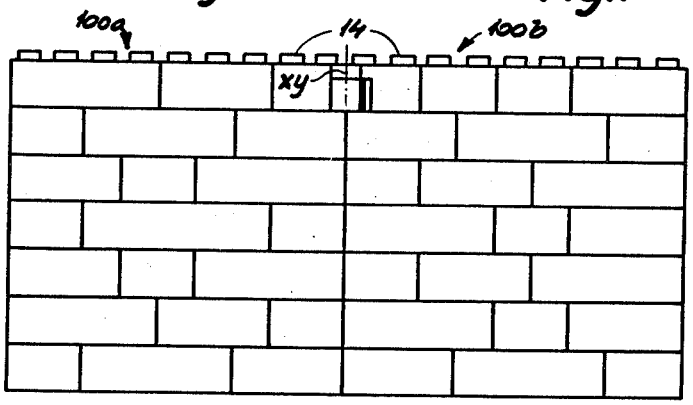
Figure 12:
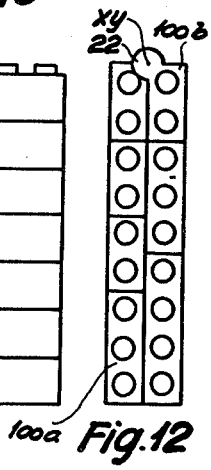

Other and ancillary objects of the invention and the characteristic features thereof will appear from the following description with reference to the drawings, wherein:

FIGS. 1, 2 and 3 are a top view, a side elevation and a bottom view respectively showing a box-shaped toy building block constituting one component of a hinge element according to the invention, FIGS. 4, 5 and 6 are similar views showing another box- shaped toy building block constituting the other component of the hinge element, FIG. 7 is a top view of the hinge element in one extreme position of the two components, FIG. 8 is a bottom view of the hinge element shown in FIG. 7, FIGS. 9 and 10 are top and bottom views respectively showing the same hinge element in another extreme position of the two components, FIG. 11 is a side elevation showing a pair of structures each comprising a plurality of interconnected toy building blocks, said structures being hingedly connected by hinge elements according to the invention in one extreme position thereof, and FIG. 12 is a top view of the same two structures in the other extreme position of the hinge elements.

Referring to the drawings, it will be observed that the hinge element shown in FIGS. 1 to 10 comprise a pair of box-shaped toy building blocks 10*a*, FIGS. 1 to 3, and 10*b*, FIGS. 5 to 6, each having two side walls 11 and two end walls 12 and a bottom wall 13 defining a cavity 16. The bottom walls 13 are provided with a pair of outwardly extending projections 14 which, in building sets of the kind referred to, are generally defined as "primary" projections. Similarly, both of the blocks 10*a* and 10*b* are provided with one projection 15 disposed in the cavity 16. These projections are referred to as "secondary" projections and are arranged and dimensioned so as to provide for enagagement with the primary projections of an adjacent toy building block in a toy building set as described in U.S. Pat. No. 3,005,282.

The two blocks 10*a* and 10*b* are substantially identical except for the provision of a tubular bush 17 in one corner of the block 10*a*, which will henceforward be designated as the bush block, and a complementary pivot pin 20 in one corner of the block 10*b*, which will henceforward be designated as the pivot block. The height of both blocks is designated as h.

The cylindrical pivot pin 20, as shown more clearly in FIG. 5, is provided at one end with a cylindrical extension (head) 21 and at the other end with an annular collar 23 which fits into a corresponding recess 19 at the bottom of the bush 17, when the two blocks are assembled, as shown in FIGS. 7 to 10.

As shown in FIGS. 2 and 5, the length of the bush 17 is equal to the length of the pivot pin 20 and hence somewhat shorter than the height h of the blocks, the distance from the top annular face 18 of the bush to the top face 13 of the block 10*a* being equal to the length of the extension 21 of the pivot. The circular top face 22 of the extension 21 is flush with the top face 13 of the pivot block 10*b*. Likewise, the annular bottom face 17*a* of the bush 17 is flush with the bottom face adjacent the open end of the bush block defined by the plane of the end faces 11' and 12' of the walls 11 and 12.

So as to provide for a snap locking effect between the pivot 20 and the bush 17 when the two components are assembled to form the hinge element, the pivot is provided with a slit 24 allowing for slight compression of the pivot 20 and the collar 23, until the latter is received in the recess 19. In that position, the pivot pin 20 with the collar 23 will again expand and prevent axial displacement of the two hingedly interconnected blocks 10*a* and 10*b*.

As shown in FIGS. 5 and 6, the side and end walls of the pivot block adjacent the pivot pin 20 are partly removed so as to leave an open space 25 to enable the pivot 20 to be inserted in the bush 17.

It is an essential feature of the invention that, in the position wherein the pivot pin 20 is rotatably mounted in the bush 17, the axis x of the bush 17 and the axis y of the pivot pin 20 both coincide with a corner edge 11–12 in each block defining an axis xy of rotation of the hinge element.

When—and only when—this geometrical condition is complied with, the hinge element according to the invention will be capable of taking up the two extreme positions shown in FIGS. 7 and 8 and 9 and 10 respectively, i.e. where two end walls 12 or two side wall 11 abut one another.

FIGS. 11 and 12 illustrate by way of example how this feature of the invention may be used for hinging two structures 100*a* and 100*b*, such as a pair of walls, each comprising a plurality of standard toy building blocks interconnected by a series of hinge elements. In one extreme position of the hinge elements corresponding to FIGS. 7 and 8, the planes of the sides of the two structures coincide, so as to form one continuous wall, whereas, in the other extreme position, the hinge elements are folded together with their side faces abutting one another, as shown in FIG. 12.

It will be understood that the two box-shaped toy building blocks of the hinge element may have another rectangular shape than the one illustrated in the drawings and may comprise an arbitrary plurality of primary and secondary projections. However, the embodiment illustrated and described with reference to the drawings will generally be considered as the preferred embodiment.

What is claimed is:

1. A hinge element comprising a pair of box-shaped toy building blocks, each having four side walls and a bottom wall defining an open inner and an outer face, at least one projection extending outwardly from one face of said bottom wall, said blocks having the same height and being hingedly connected along one corner of each block defined by a pair of adjacent side walls, one of said blocks having a tubular bush and the other block having a complementary cylindrical pivot pin, the location of said bush and pivot pin relative to the blocks being such that the pivot pin is rotatably mountable within the bush with the axis of the bush, the axis of the pivot pin and the axis of a corner edge in each block coinciding.

2. A hinge element, as claimed in claim 1, wherein the pivot pin is provided with a cylindrical extension having the same diameter as the outer diameter of the bush and a circular top face which is flush with the outer face of the pivot block and the bush has a bottom face, the total length of the pivot pin including the extension being equal to the height of the block, the bottom face of the bush being flush with the open inner face of the bush block and, the length of the bush being equal to the length of the pivot pin.

3. A pivot block for a hinge element, as claimed in claim 1, in which the side walls adjacent the pivot pin are slotted to facilitate insertion of the pivot pin into the bush of the bush block.

* * * * *